United States Patent [19]

Grobler

[11] Patent Number: 4,836,926

[45] Date of Patent: Jun. 6, 1989

[54] STAGGERED SPIRAL SPLITTERS

[75] Inventor: Hans J. Grobler, Schoemansville, South Africa

[73] Assignee: Mineral Deposits Limited, Australia

[21] Appl. No.: 74,714

[22] Filed: Jul. 17, 1987

[30] Foreign Application Priority Data

Jul. 21, 1986 [AU] Australia ..... PH7044

[51] Int. Cl.[4] ..... B03B 5/52

[52] U.S. Cl. ..... 210/512.1; 209/459; 209/493

[58] Field of Search ..... 210/239, 240, 512.1, 210/512.2, 512.3; 209/144, 211, 459, 493; 55/393, 407, 452, 456

[56] References Cited

U.S. PATENT DOCUMENTS

| | | | |
|---|---|---|---|
| 1,382,846 | 6/1921 | Merrill | 55/393 |
| 2,615,572 | 10/1952 | Hodge | 209/211 |
| 3,672,503 | 6/1972 | Mark | 209/144 |
| 4,597,861 | 7/1986 | Wright | 209/459 |

FOREIGN PATENT DOCUMENTS

| | | | |
|---|---|---|---|
| 46168 | 8/1972 | Australia . | |
| 37175 | 1/1978 | Australia . | |
| 536090 | 7/1982 | Australia . | |
| 8603140 | 6/1986 | PCT Int'l Appl. | 209/493 |
| 388787 | 11/1973 | U.S.S.R. | 209/144 |
| 597426 | 3/1978 | U.S.S.R. | 209/211 |

*Primary Examiner*—Richard V. Fisher
*Assistant Examiner*—Linda S. Evans
*Attorney, Agent, or Firm*—Stevens, Davis, Miller & Mosher

[57] ABSTRACT

A spiral separator 1 is provided with a first pivotally mounted splitter (6) having an upstream working edge for dividing a slurry descending the sluice into two streams (A,B). A second pivotably mounted splitter (8) is positioned downstream and radially outwardly of the first and divides stream B into two streams (C, D) the second splitter being moveable to a position adjacent the downstream end of the first.

8 Claims, 1 Drawing Sheet

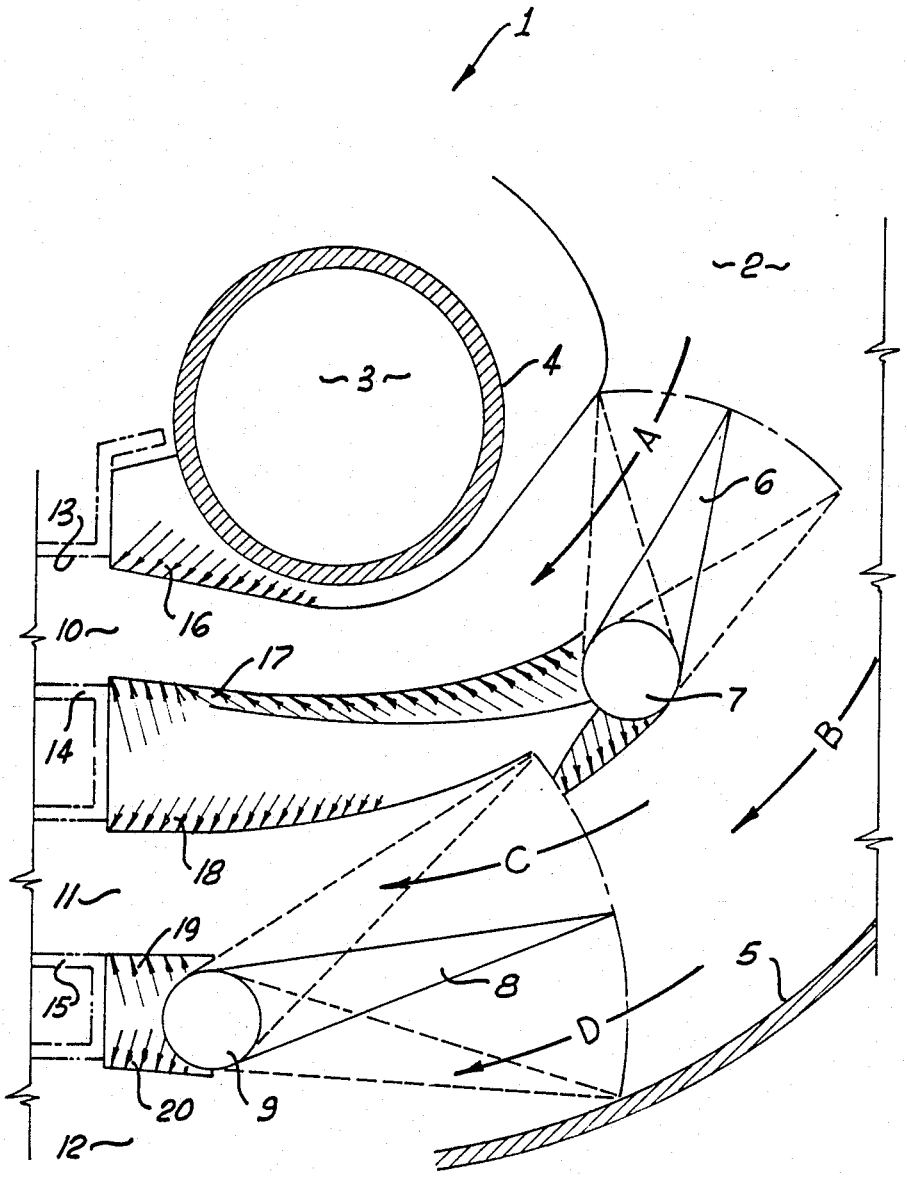
1
2
3
4
A
6
13
16
10
17
7
14
B
18
C
11
19
5
8
15
D
20
9
12

STAGGERED SPIRAL SPLITTERS

This invention relates to staggered splitters for use with a spiral separator, i.e. an apparatus for the separation of particles of higher density from particles of lower density when a mixture of such particles suspended in a slurry is fed through the separator. The separator is in the form of a generally helical sluice supported with the helix axis upright.

It is usual to feed a stream of slurry, for example water containing suspended solids, into the upper part of such a sluice and to permit the liquid and solids to flow down the sluice under gravity. If the shape of the sluice is correctly chosen, the denser particles tend to travel more slowly than the less dense particles and under the influence of gravity tend to concentrate towards the inner edge of the sluice, where a fraction of concentrated heavy particles may be removed by means of a splitter and a take-off.

BACKGROUND ART

Australian Patent Application No. 46168/72 describes a splitter having a blade extending vertically and mounted for rotation about an upright pivotal axis in relation to a conical or cylindrical take-off in the floor of the sluice with the vertical blade diverting adjustable proportions of concentrate into the take-off. Such devices have the disadvantage that the maximum adjustment range is limited by the necessarily planar face to the top of the take-off where the splitter rotates and the incorporation of such a planar surface into the floor of the helical sluice causes severe distortion to the normal shape of the latter with consequent flow distortion if the take-off is of excessive diameter. In this case also, the protruding splitter blade causes severe flow disturbance when rotated to a position such that little or no concentrate is taken.

In some separators the blade is mounted for translation in a radial direction as is described in Australian Patent Number 522914. Other separators have been provided with a splitter blade which is mounted for rotation about an axis normal to the floor of the volute, that is to say substantially parallel to the axis of the volute. In such cases the position of separation is adjusted by rotating the splitter blade about its axis. A portion of the splitter blade upstream of the axis, upon rotation, traverses the volute, and so adjustment is achieved.

A plurality of splitters have previously been used in spiral separators wherein a pair of splitter blades are positioned side-by-side at the bottom of the sluice wherein a concentrate/middlings splitter is positioned in the inner part of the sluice and a middling/tailings splitter is positioned adjacent to but further outward in the same radial area of the sluice with particles of high density being referred to as concentrates, of intermediate density as middlings and of low density as tailings although high or low density fractions may be the valuable compound. Such an arrangement is shown in Australian Pat. No. 536,090 by Douglas Charles Wright. The splitter blades operate side-by-side as shown in FIG. 1 of that patent specification and this avoids flow interaction between the two splitter blades. However this also results in some limitations in the effective range over which each splitter blade may be adjusted. The problem is that the arcs of movement of the splitter blades may not overlap since the shapes of the surfaces on which the splitters seat on the sluice conflict.

BACKGROUND OF THE INVENTION

For some applications, it is desirable that the effective ranges of each splitter blade should overlap particularly to permit the middlings/tailings splitter blades to move within the range of the concentrate/middlings splitter blade so that small middlings quantities may be taken even when small concentrate quantities are taken. This can be accomplished by moving the middlings/tailing splitter blade down the sluice so that its arc of travel overlaps the arc of travel of the concentrate/middlings splitter blade when measured radially. The second splitter blade is located a sufficient distance downstream on the helical sluice to avoid overlapping of the splitter blade seating surfaces. If the inner limit of travel of the middlings/tailing splitter blade is moved radially inwards to effectively coincide with the axis of rotation of the concentrate/middlings splitter blade, the middlings product quantity may be reduced to zero whatever the setting of the concentrate/middlings splitter blade. Although the sluice surface is distorted upstream of the middlings/tailing splitter blade by the concentrate/middlings splitter blade and its seating surface, it is possible to profile these upsteam distortions to reduce the consequent losses of spiral separator efficiency to extremely low levels.

SUMMARY OF THE INVENTION

The invention consists in a splitter assembly for dividing a flow of particles or slurry descending a sluice of a spiral separator, said assembly comprising a first pivotally mounted splitter blade having an upstream working edge and a second pivotally mounted splitter blade positioned downstream of said first splitter blade, said second splitter blade having an upstream working edge moveable from a position adjacent to the downstream end of the first splitter to a position spaced therefrom radially outwardly.

According to a second aspect of the invention the second splitter blade is moveable in an arc extending outwardly from the first splitter blade.

The present invention will now be described by way of example only with reference to the accompanying drawing which shows a plan view of a splitter arrangement according to the invention.

BRIEF DESCRIPTION OF THE DRAWINGS

The sole FIGURE is a top view, partly in section, of a spiral separator having the staggered splitters of this invention.

Referring to the drawings, a spiral separator 1 comprises a sluice 2 helically mounted on a separator column 3, the sluice having an inner wall 4 immediately adjacent said column and an outer sluice wall 5. On the floor of the sluice is positioned first splitter blade 6 pivotally mounted on pin 7. Downstream from splitter blade 6 is mounted splitter blade 8 on pivot 9. As can be seen from the drawing splitter blade 6 is moveable through an arc or approximately 55° and splitter blade 8 which is mounted below blade 6 and nearer the outer wall 5 is also moveable through an arc of about 50°, such as an arc of approximately 51° including a position where the blade is substantially tangential to a portion of the flow of particles or slurry. Splitter blade 8 may be positioned with its upstream point adjacent outer wall 5 or may be moved to a location behind pivot 7 of splitter 6. As shown in the drawing a flow of particles or slurry descending the sluice of the spiral separator encounters the first splitter blade 6. By adjustment of splitter blade 6 concentrate "A" is directed via discharge 10 (defined between baffle walls 13 and 14) while the residue "B" is directed toward the area nearer outer sluice wall 5. As the residue "B" continues downwardly it encounters second splitter blade 8. As can be seen from the drawing the middlings and tailings "D" are directed by blade 8 toward the outer sluice wall 5 and discharge 12. A portion "C" may be redirected as middlings via discharge 11 (defined between baffle walls 14 and 15) by adjustment of the splitter blade 8.

Flow "A", is further directed towards discharge 10, by sloping parts of the trough floor indicated at 16 and 17. Flow "C" is directed towards discharge opening 11 by sloping parts of the trough floor 18 and 19, while flow "D" is directed towards discharge 12 by slope 20.

The present invention extends to spiral separators having two or more volute discharges like those indicated at 10 and 11 and 12 in the drawing. A plurality of spiral separators according to the present invention may be envisaged and are usually employed for greater efficiency and conservation of plant space and the splitters of one spiral may be ganged with those of another.

I claim:

1. A spiral separator comprising a helical sluice of a generally U shaped cross section with a floor and a radial inner wall and a radial outer wall, further including a splitter assembly for dividing a flow of liquid suspended particles or slurry descending said sluice comprising a pair of pivotally mounted splitter blades each having an upstream working edge wherein the first pivotally mounted splitter blade is positioned to divert a portion of said flow onto the upstream working edge of the second splitter blade which is positioned adjacent the downstream end of the first splitter blade and spaced therefrom radially outwardly, and means for pivoting each of the splitter blades.

2. A splitter assembly according to claim 1 wherein the upstream working edge of said second splitter blade is mounted for movement by said means for pivoting to be moveable in an arc extending radially outwardly from said first splitter blade.

3. A splitter assembly according to claim 2 wherein said means for pivoting is connected to enable said first splitter blade to be moveable through an arc of about 55° and said second splitter blade through an arc of about 50°.

4. A splitter assembly according to claim 1 wherein said means for pivoting permits each working edge to be moveable to a position substantially tangential to a portion of the flow of said particles or slurry.

5. A splitter assembly according to claim 1, wherein said first splitter blade is positioned to direct one portion of said flow of said particles toward a first discharge outlet and said second splitter blade is positioned to direct a second portion of said flow of particles to a second discharge outlet.

6. A splitter assembly according to claim 5 wherein said second splitter blade is positioned to direct a third portion of said flow of particles to said outer sluice wall.

7. A spiral separator comprising a helical sluice of a generally U shaped cross section with a floor and a radial inner wall and a radial outer wall, further including a splitter assembly for dividing a flow of liquid suspended particles or slurry descending said sluice comprising:

a first splitter blade pivotally mounted in said sluice by a pivot point for movement in an arc with an upstream working edge thereof moveable from a position where it contacts the radial inner wall of said sluice to a position radially outwardly thereof;

a second splitter blade pivotally mounted in said sluice at a position that is both downstream of said first splitter blade and radially outward thereof, said second splitter blade having an upstream working edge moveable from a position where it contacts the radial outer wall of said sluice to a position radially inward thereof where said upstream working edge is in radial alignment with said pivot point of the first splitter blade; and means for pivoting each of the splitter blades.

8. The splitter assembly of claim 7 including sloping parts in the floor of said sluice for directing particles or slurry toward a discharge opening.

* * * * *